United States Patent [19]

Frost

[11] 3,986,707

[45] Oct. 19, 1976

[54] EXPANSION MIXER

[76] Inventor: Homer E. Frost, Rte. 1, Lynchburg, Ohio 45142

[22] Filed: Oct. 31, 1974

[21] Appl. No.: 519,784

[52] U.S. Cl. ..... 259/41

[51] Int. Cl.[2] ..... B01F 7/00; B01F 15/02

[58] Field of Search ..... 259/41, 38, DIG. 9, 259/DIG. 25, DIG. 26, DIG. 27, DIG. 5, 160, 152, 7, 31, 19; 4/194

[56] References Cited

UNITED STATES PATENTS

| | | | |
|---|---|---|---|
| 419,200 | 1/1890 | Kahlenberg | 259/DIG. 26 |
| 1,762,081 | 6/1930 | Schleicher | 259/DIG. 27 |
| 2,689,114 | 9/1954 | Hammond, Jr. | 259/DIG. 26 |
| 3,243,163 | 3/1966 | Brown | 259/7 |

FOREIGN PATENTS OR APPLICATIONS

| | | | |
|---|---|---|---|
| 560,128 | 7/1958 | Canada | 259/DIG. 27 |

*Primary Examiner*—Leonard D. Christian
*Assistant Examiner*—Donald B. Massenberg

[57] ABSTRACT

An apparatus for mixing dry and liquid materials, and which incorporates means for expansion of the materials by volume measurement; the present apparatus including a mixing tank through the upper end of which there extend downwardly a pair of, parallel spaced apart drive shafts each of which has a smaller upper agitator and a larger lower agitator, the upper ends of the drive shafts being powered by direct drive hydraulic motors of variable speeds, the apparatus additionally including a centrally spaced downward shaft between the agitator shafts and which carries an adjustable baffle so to increase the agitation within the mixing tank.

1 Claim, 11 Drawing Figures

EXPANSION MIXER

This invention relates to a mixing apparatus.

A principal object of the present invention is to provide an expansion mixer that is designed to mix dry and liquid materials, and which may be expanded by volume if so wished.

Another object of the present invention is to provide an expansion mixer that is designed for a higher volume output at a shorter length of time.

Still another object of the present invention is to provide an expansion mixer in which an agitator assembly may be lowered or raised for a considerable distance.

Still another object of the present invention is to provide an expansion mixer in which the agitators may be driven at variable speeds.

Still another object of the present invention is to provide an expansion mixer wherein during the process of mixing, some materials which are thrown to the outside of the mixing tank are pulled back into the agitator by means of fins on the bottom of the agitator blades.

Still a further object is to provide an expansion mixer which incorporates a rubber seal on the bottom of a baffle shaft so to close off a discharge in the center of the mixing tank when the agitator assembly is in a lower position, and wherein when the mix has expanded, the baffle shaft is raised by a hydraulic cylinder so that the material can flow out the bottom of the mixing tank into a pump.

Still a further object is to provide an expansion mixer in which the mixing may be done as a batch or as a continuous mix.

Other objects are to provide an expansion mixer which is simple in design, inexpensive to manufacture, rugged in construction, easy to use and efficient in operation.

These and other objects will be readily evident upon a study of the following specification and the accompanying drawings, wherein.

Figure 7:
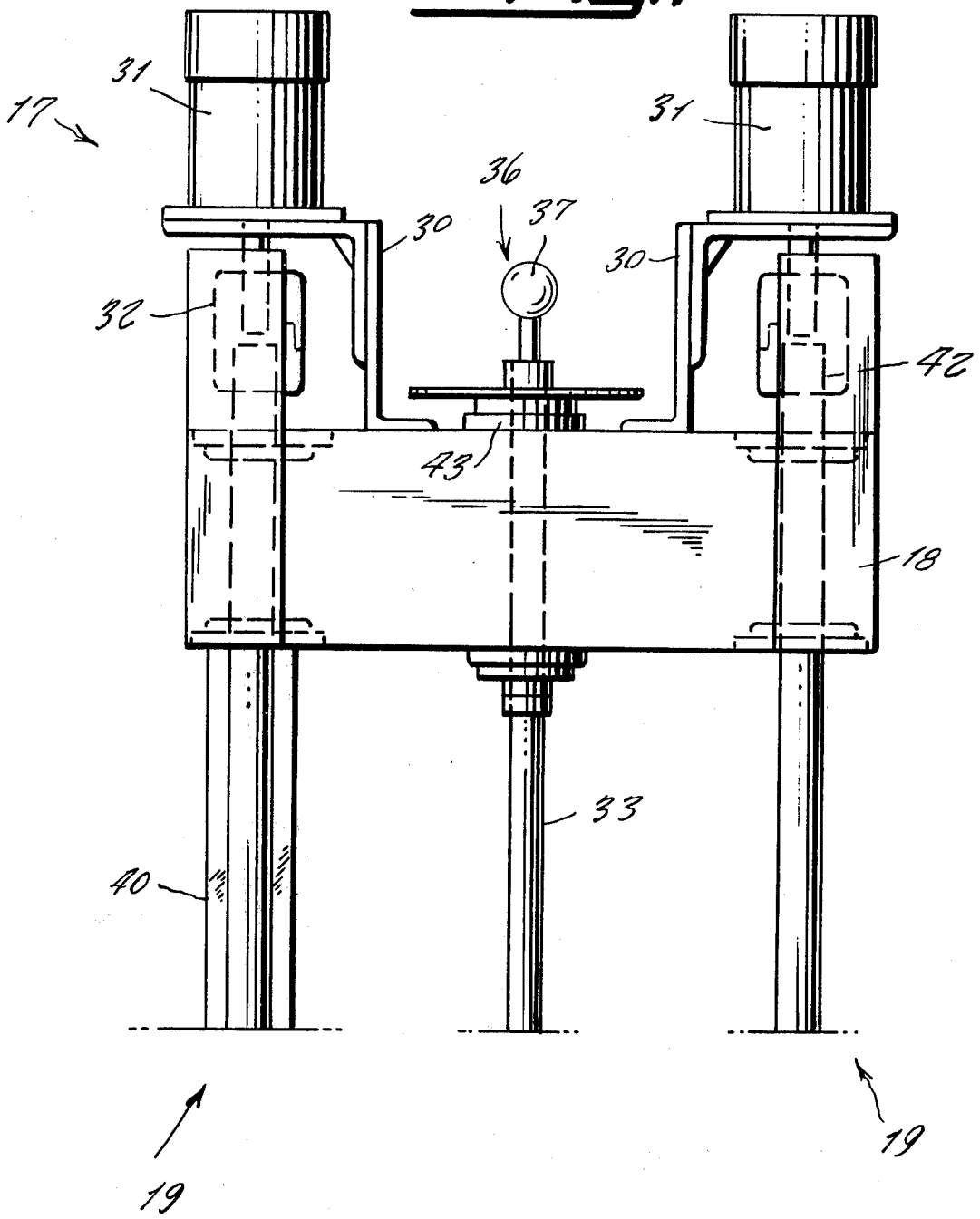
Figure 7A:
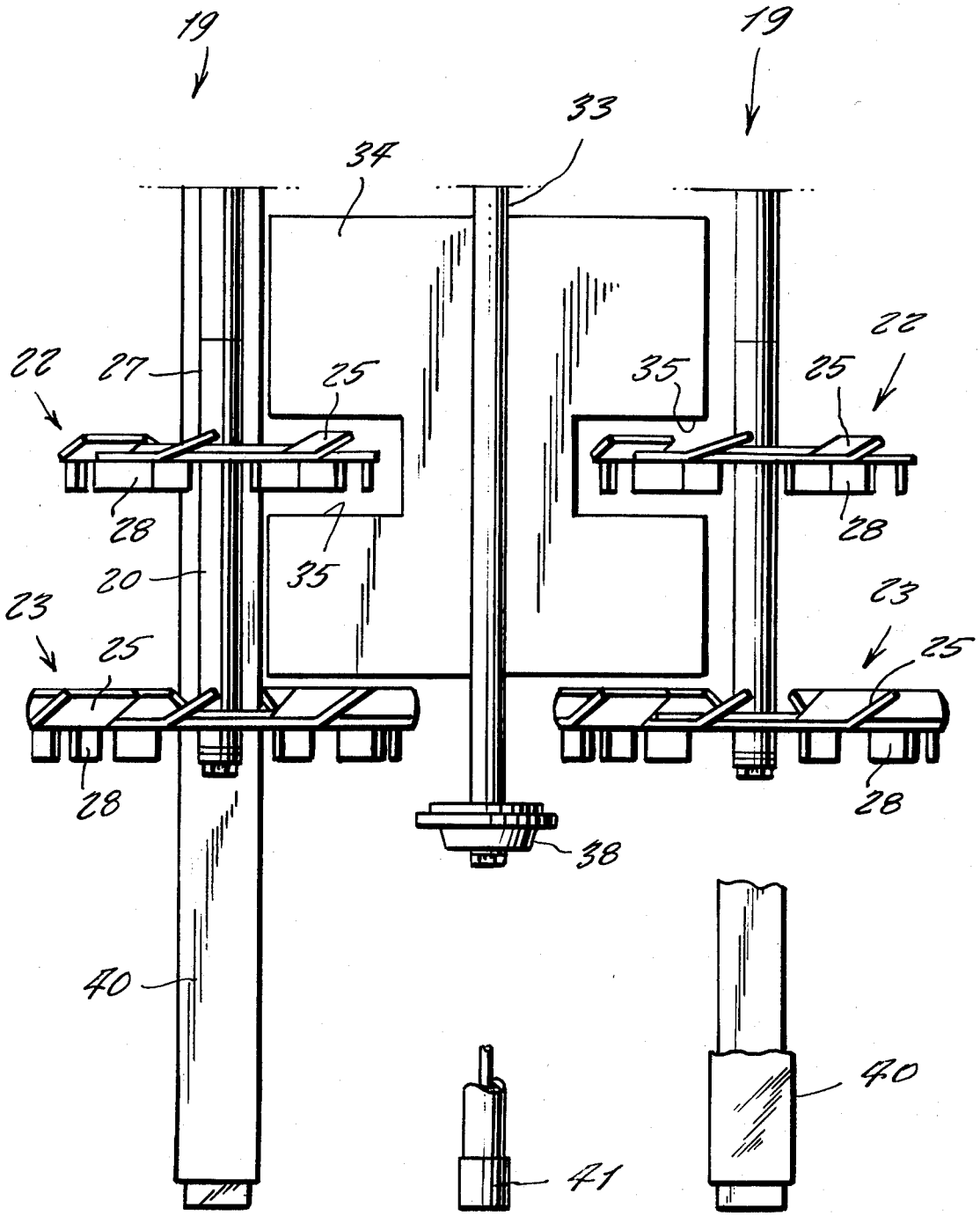

FIG. 7 and FIG. 7A together form a composite view showing the agitator assembly in elevation.

Figure 8:
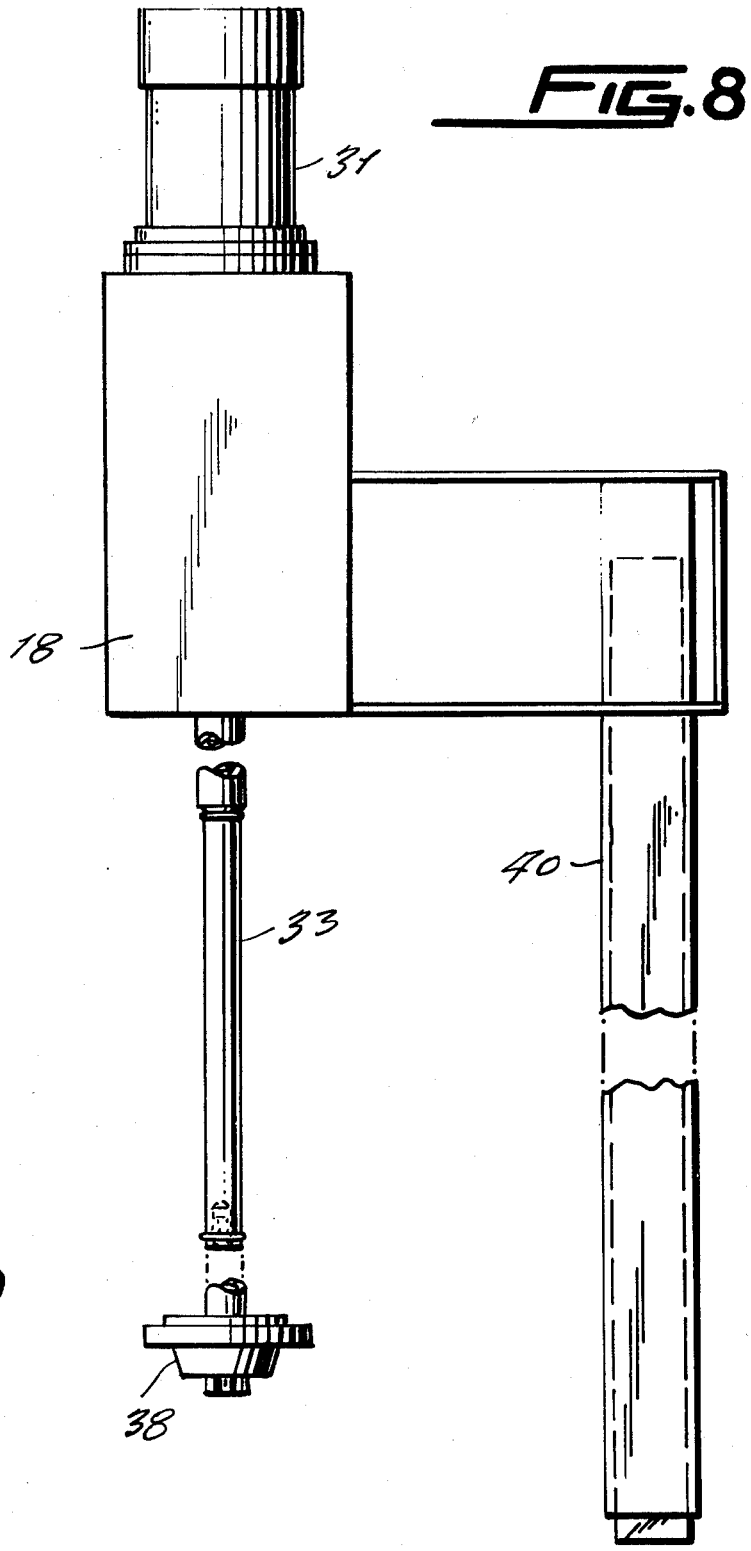

FIG. 8 is a fragmentary end elevation view of the agitator assembly, shown without the agitator tubing and shaft.

Figure 9:
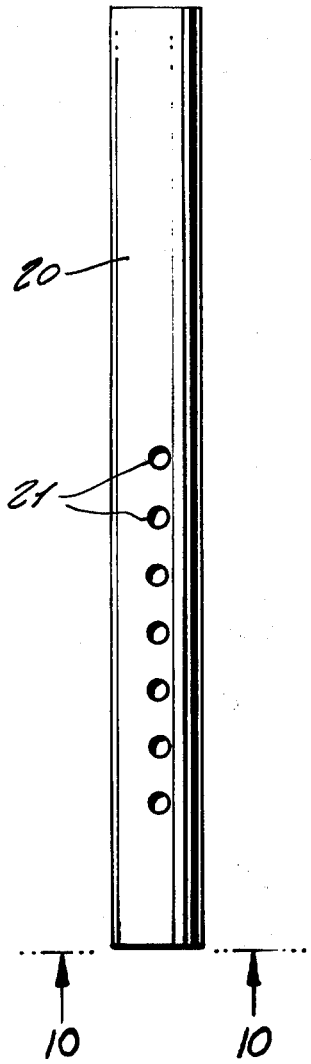

FIG. 9 is an elevation view of one of the agitator blade shafts.

Figure 10:
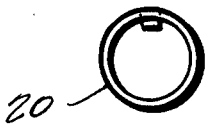

FIG. 10 is an end view of the agitator blade shaft as viewed on line 10—10 of FIG. 9.

Referring now to the drawings in detail, the reference numeral 10 represents an expansion mixer according to the present invention, the same being mounted upon a transportable platform 11 that is mounted upon a plurality of casters 12 provided with caster wheels 13.

Upon the platform 11 there is also mounted a hopper 14 and a control unit 15 which are associated with expansion mixer 10.

The expansion mixer includes a vertically extending mixing tank 16 which is open on top so that an agitator assembly 17 can be inserted downwardly thereinto, and which includes a main block 18 extending horizontally and which near each opposite end supports an agitator unit 19.

Figure 1:
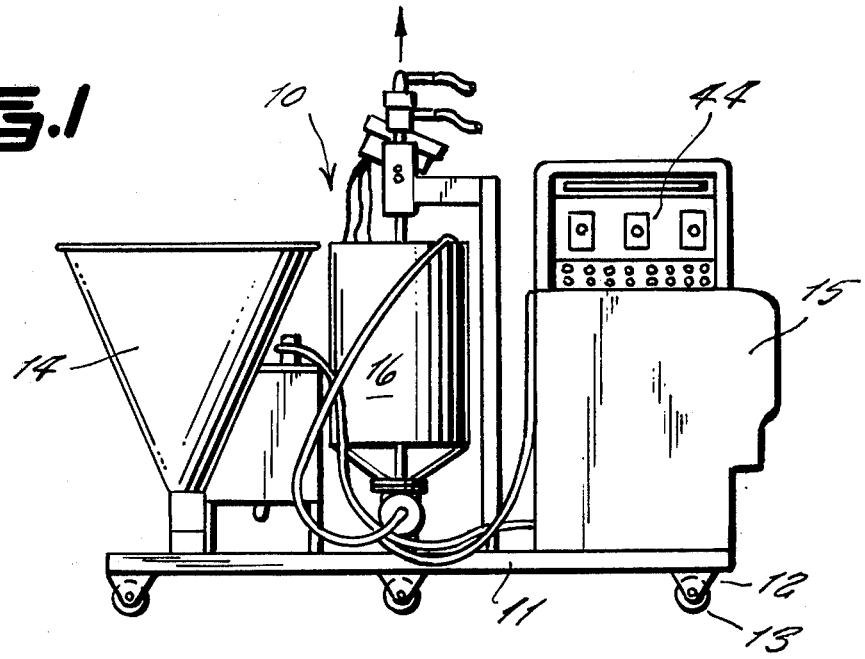
FIG. 1 is a front perspective of the present invention.
Figure 2:
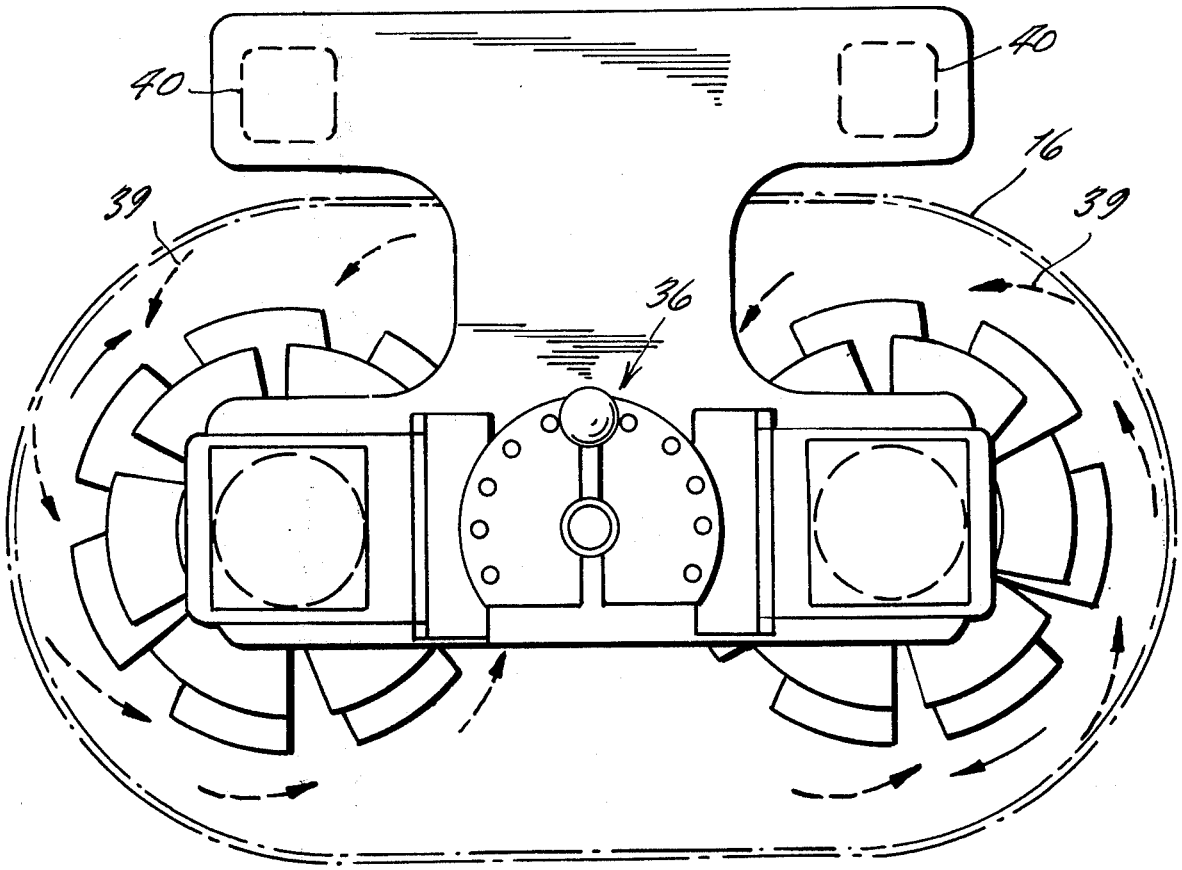
FIG. 2 is an enlarged plan view of the agitator assembly, and showing the mixing tank in phantom lines.
Figure 3:
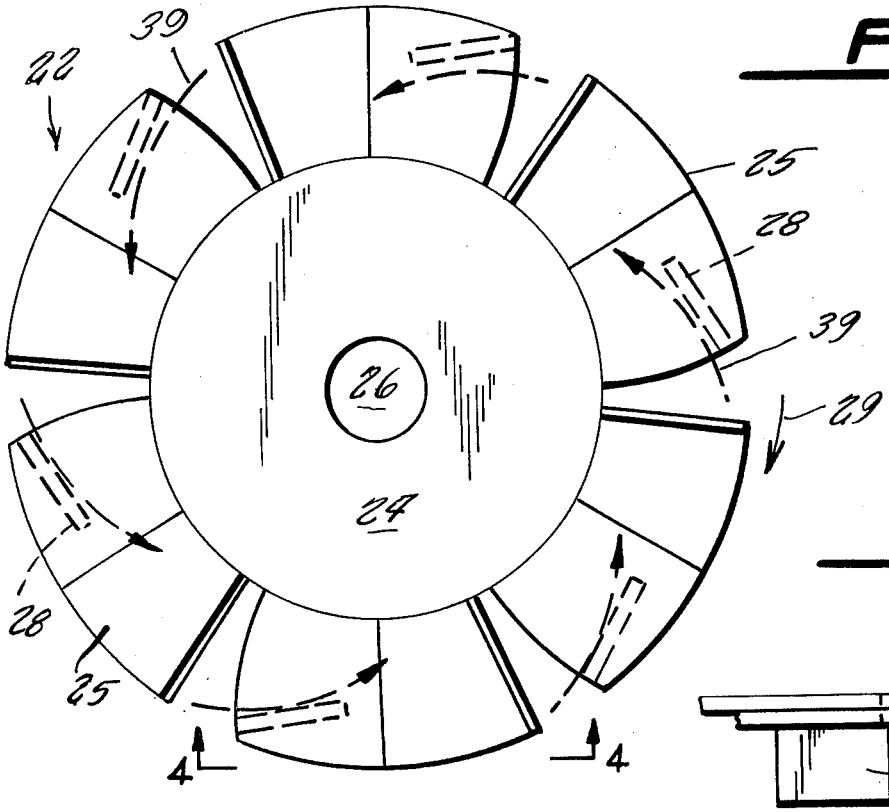
FIG. 3 is an enlarged top plan view of one of the upper agitator blade units shown removed from the assembly.
Figure 4:
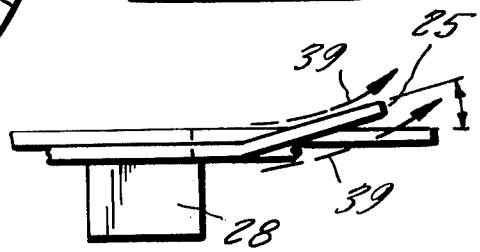
FIG. 4 is a fragmentary view taken along the line 4—4 of FIG. 3.
Figure 5:
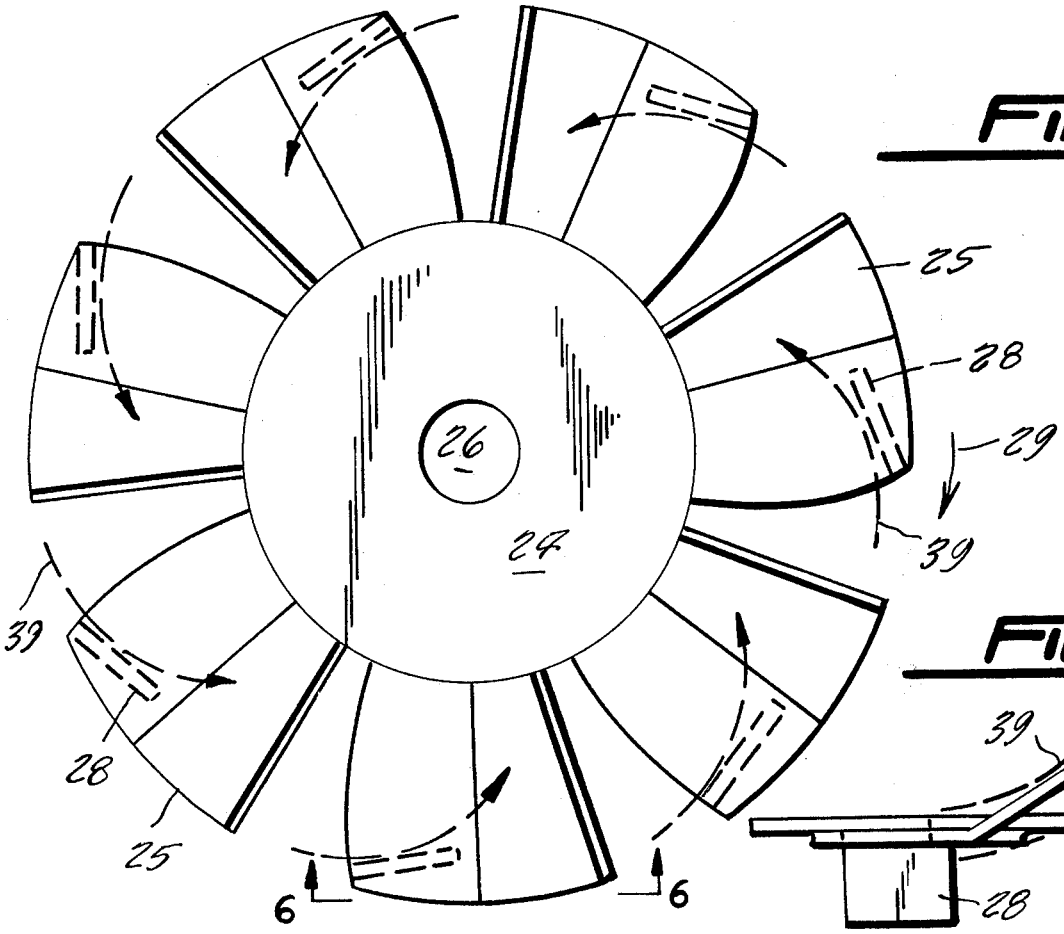
FIG. 5 is an enlarged top plan view of one of the lower agitator blade units, shown removed from the assembly.
Figure 6:
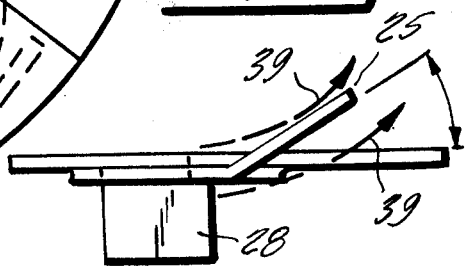
FIG. 6 is a fragmentary view taken along the lines 6—6 of FIG. 5.

Each agitator unit 19 includes a vertical shaft and tubing 20 perforated with a plurality of equally spaced apart transverse openings 21 and which is located between upper agitator 22 and a lower agitator 23. The upper agitator is relatively smaller than the lower agitator by being 9¾ inches in diameter whereas the lower agitator is 11¾ inches in overall diameter. Each of the agitators includes a circular central stainless steel plate 24 around the periphery of which there are a plurality of equally spaced apart blades 25. Each of the stainless steel plates 24 are provided with a central opening 26. for purposes of being mounted between tubings 20 and 27 around the unit shaft. As shown in FIGS. 4 and 6, each of the agitators 22 and 23 also include a plurality of vertically downwardly extending fins 28 on the underside thereof and which serve to pull materials outwardly thrown, back into the agitator by the fins, each of the agitators 22 and 23 rotate in a clockwise rotation as indicated by the arrows 29.

On top of the main block 18 there are mounted a pair of brackets 30 one of which supports a Vickers piston motor which comprises a direct direct drive hydraulic motor which has variable speed from zero to 350 rpm's. These motors 31 drive each of the agitator units 19 through a mercury coupling 32.

At the longitudinal center of the main block 18 there is a vertically extending baffle shaft 33 supported thereby, and which supports an adjustable baffle 34 located between the agitator units 19. The adjustable baffle 34 includes notches 35 on each opposite side edge serves to clear the upper agitators 22. The lower edge of the adjustable baffle is positioned directly above the lower agitator 23. The adjustable baffle serves to increase or decrease the agitating or the bypassing. Adjustment of the baffle 24 accomplished by means of a baffle positioning mechanism 36 which includes the spherical control knob 37 at the upper end of the baffle shaft.

At the lower end of the baffle shaft there is a rubber seal 38 which serves to close off the discharge in the center of the mixing tank when the agitator assembly is in a lower position.

In FIGS. 3, 4, 5, 6 and 7, the dotted arrows 39 indicate upward and inward flow of the liquid. This opposes the normal centrifical force and lifts solids from the bottom of the tank.

Referring now to FIG. 7, the figure illustrates the agitator structure in a lowered position. However it can be elevated approximately 36 inches. In the figure, the reference numeral 40 represents a square tubing as shown. A hydraulic cylinder is shown at 41. A keyway 42 is shown included in each of the agitator units 19. At 43 there is shown Dodge flange bearings for the baffle shaft 33.

In operative use, the hydraulic motors 31 being of variable speeds may be set for different applications, may be set for a desired speed by a dial on the panel 44 of the control unit 15. After calibrating the speeds needed for the application, the dial on the panel of the machine is locked with a key and cannot be changed without unlocking.

In operation, the agitators all turn in a clockwise rotation, and through the adjustability of the baffle 34 the agitation can be increased or decreased by bypassing. The rubber seal 38 closes off the discharge in the center of the mixing tank when in the lower position. When the mix has expanded, the baffle shaft is raised by the hydraulic cylinder 41 so that the material can flow out of the bottom of the mixing tank into the pump. It can be mixed either as a batch or as a continuous mix.

While in the process of mixing, some materials are thrown to the outside of the mixing tank, and these are pulled back into the agitator by the fins 28 on the bottom of the blades 25. An important feature of the present invention comprises that the upper agitators 22 start the mixing action and the materials finally seek the level of the lower agitators 23 which are larger and do the final mixing action. Thus the expansion blades 25 of the upper agitators 22 start the expansion mixing and which is completed in expansion mixing by the blades of the lower agitators.

Thus there is provided an expansion mixer of improved type that serves a needed use in various industries.

While various changes may be made in the detail construction, it is understood that such changes will be within the spirit and scope of the present invention as is defined in the appended claims.

What I claim is:

1. In an expansion mixer, the combination of an apparatus mounted upon a platform, said platform being mounted upon casters in order to be transportable, said platform additionally supporting a hopper and a control unit, and said apparatus incorporating means for selective expansion mixing of dry and liquid materials, said means comprising said expansion mixer apparatus including a mixing tank, an upper end of said mixing tank being open and an agitator assembly extending downward into said mixing tank, said agitator assembly including a horizontally extending main block, opposite ends of said main block supporting a pair of vertically extending agitator units, and the center of said main block supporting a vertically downward extending baffle shaft positioned equidistant between said agitator units, a pair of tubing-enclosed vertical shafts, each one of said agitator units including one of said vertically extending shafts, and supporting a pair of vertically spaced apart agitators, an upper of said agitators being of a smaller diameter and a lower of said agitators being of a larger diameter, each one of said agitators comprising a central, circular stainless steel plate having a central opening for being mounted upon said shaft, a periphery of said plate having a plurality of spaced apart blades, and an underside of said blades having a plurality of downwardly extending fins secured thereto, an upper end of each of said agitator units having a direct drive hydraulic motor for rotation of said upper and lower agitators, said baffle shaft supporting an adjustable baffle located between said upper agitators, and an upper end of said baffle shaft including a baffle positioning mechanism that includes a control knob, a lower end of said baffle shaft including a rubber seal of circular configuration which, when lowered, closes off discharge in the center of said mixing tank of said mixer.

* * * * *